United States Patent [19]

Yasuhara

[11] 4,318,374

[45] Mar. 9, 1982

[54] PREHEATING SYSTEM FOR A DIESEL ENGINE

[75] Inventor: Seishi Yasuhara, Yokosuka, Japan

[73] Assignee: Nissan Motor Co., Ltd., Yokohama, Japan

[21] Appl. No.: 59,629

[22] Filed: Jul. 23, 1979

[30] Foreign Application Priority Data

| | | | |
|---|---|---|---|
| Aug. 18, 1978 | [JP] | Japan | 53-113158[U] |
| Sep. 18, 1978 | [JP] | Japan | 53-113667 |
| Oct. 24, 1978 | [JP] | Japan | 53-146050[U] |
| Nov. 21, 1978 | [JP] | Japan | 53-142905 |

[51] Int. Cl.[3] ..... F02P 19/02

[52] U.S. Cl. ..... 123/179 BG; 123/179 H

[58] Field of Search ..... 123/145 A, 179 B, 179 BG, 123/179 H

[56] References Cited

U.S. PATENT DOCUMENTS

| | | | |
|---|---|---|---|
| 3,675,033 | 7/1972 | Richard et al. | 123/145 A |
| 4,075,998 | 2/1978 | Krauss et al. | 123/179 BG |
| 4,106,465 | 8/1978 | Bernhardt et al. | 123/179 BG |
| 4,177,785 | 12/1979 | Sundeen | 123/145 A |
| 4,221,205 | 9/1980 | Koehler | 123/179 BG |

FOREIGN PATENT DOCUMENTS

| | | | |
|---|---|---|---|
| 2205108 | 11/1972 | Fed. Rep. of Germany | 123/179 BG BG |
| 2383326 | 11/1978 | France | 123/145 A |
| 1299589 | 12/1972 | United Kingdom | 123/179 BG |

*Primary Examiner*—Charles J. Myhre
*Assistant Examiner*—Andrew M. Dolinar
*Attorney, Agent, or Firm*—Lowe, King, Price & Becker

[57] ABSTRACT

A preheating system for a Diesel engine of a type including a preheating plug energized through a glow relay, and a charging switch for deenergizing the glow relay when the charging switch detects engine starting, the system comprises a glow switch adapted to be closed in response to insertion of an engine key into an engine key switch, and a timer switch for exciting the glow relay for pre-determined period of time after closing of the glow switch.

In accordance with a second embodiment, the preheating system further comprises a second glow switch, a glow plug preheating circuit established from the second glow switch through contacts of a self-holding relay to the glow plug, and circuitry for sensing overheating of the glow plug and in response interrupting the glow plug preheating circuit.

20 Claims, 17 Drawing Figures

PREHEATING SYSTEM FOR A DIESEL ENGINE

BACKGROUND OF THE INVENTION

1. Field of the Invention

The present invention relates to a preheating system for a Diesel engine, and more particularly to a preheating system for heating a preheating or glow plug of a Diesel engine to facilitate engine starting.

2. Description of the Prior Art

In a Diesel engine having a preheating or glow plug, before cranking the engine by driving a starter motor, the preheating plug is energized to become heated to a temperature at which the starter motor is started. The time required for the preheating depends mainly upon temperatures of the engine. For example, at a temperature higher than 20° C. the preheating time is less than a few seconds, and at −20° C. it becomes as much as 60 seconds. Accordingly, the engine can readily be started for a short period of time in warm environments or in summer season without requiring the preheating, while in cold environments or in winter preheating for a long time is required.

In general, a switch for energizing the preheating plug is integrally provided in an engine starter switch. An engine key is inserted into the starter switch and rotated to a preheating position and after a determined period of time has been lapsed the engine key is rotated to a starting position.

In starting a Diesel engine, a driver opens a door of a vehicle, sits on a seat, wears seat belts, inserts an engine key into a switch and operates the switch to preheat a preheating or glow plug and, after a completion of the preheating, further operates the switch to drive a starter motor. The time for the completion of the preheating is as much as 40–60 seconds in cold season for example at atmospheric temperature −10° to −20° C. During such a period of time, the driver must wait for the lapse of time sitting on the cold seat which may be uncomfortable and troublesome. Thus, Diesel engine cars have not been acceptable although they have various advantages.

When the temperature of the engine is relatively high, only a short period of time for the preheating is required. With such a relatively high temperature, however, a starting of the engine without any preheating is rather unfavorable; starting may be remarkably improved by a preheating of a short period such as a few seconds. Since a driver usually wishes to start the engine as early as possible, he is apt to neglect the preheating, if it is possible.

It has been proposed to begin the preheating by opening a door of a vehicle. However, the door is frequently opened other than in starting the engine, so that a glow plug is unduly heated every opening of the door resulting in its failure.

Even after the start of an engine, the engine tends to stall if its temperature is not sufficiently high. If it does not stall, the combustion rate of a fuel is low, making a nuisance of noise and smoky exhaust gases.

To solve this problem, it has been proposed to continue preheating a glow plug for a period of time after start of an engine thereby improving the starting performance of a Diesel engine. Such a process is referred to as "after-glowing" system.

With this system, however, it is required to provide delay means for continuing to supply a current to the glow plug for the period of time after the start of the engine. Such delay means are a temperature sensor which senses the temperature in the engine to be a determined one and a switch adapted to be operated when the vehicle reaches a predetermined speed. These means are expensive and poor in practical usefulness for lack of durability.

In usual preheating system, a driver visually confirms how a preheating or glow plug has been heated by means of a glow lamp and thereafter starts an engine.

With the recent progress of the technical field, it becomes possible to start an engine at a normal temperature without heating the glow plug. However, the time required for cranking a starter motor is long and therefore there is a tendency for durability of a battery and driving system to be shortened.

With the popularization of Diesel engine cars, moreover, unskilled drivers would fail in judgement of the preheated condition by estimating the brightness of glow lamps and start engines under insufficiently preheated conditions with resulting more elongated cranking time. At a low temperature, such as lower than 10° C., the preheating becomes more important and the start of the engine is very difficult under the insufficiently preheated condition.

The driver's judgement of preheating by evaluating the brightness of the glow lamp is generally unreliable. Moreover, it is painful for the driver to notice the glow lamp in a cold vehicle for several tens of seconds and during this period of time the driver cannot turn his attention to other operations.

SUMMARY OF THE INVENTION

It is an object of the invention to provide a preheating system for a Diesel engine, which remarkably facilitates a start of the engine without requiring a particularly intentional operation of a driver.

It is another object of the invention to provide a preheating system for a Diesel engine, which is durable in use and capable of remarkably reducing the time required for preheating.

It is further object of the invention to provide a preheating system for a Diesel engine, which can be constructed by adding simple means to an existing preheating system.

It is still more specifier object of the invention to provide a preheating system for a Diesel engine, which is useful and durable and inexpensive to manufacture and whose circuit for energizing a preheating plug is adapted to be interrupted by means of an oil pressure switch adapted to open when the pressure in an engine oil reaches a determined pressure.

It is another object of the invention to provide a preheating system for a Diesel engine, which is provided with acoustic warning means for reporting a preheated condition which is particularly preferable for an unskilled driver and permits the driver to pay attention to other operations, prevents the driver from failing to start an engine and thereby to eliminate a severe use of the engine driving system and eliminates the troublesome repetition of operations for starting the engine.

A preheating system for a Diesel engine including a preheating plug supplied with an electric current through a glow relay, and a charging switch for deenergizing said glow relay when the charging switch detects starting of said engine, according to the invention, comprises an instantaneous glow switch closed at a moment that an engine key is inserted into an engine key switch, and a timer switch for exciting said glow relay for a determined period of time after the closing of said glow switch.

The invention will be more fully understood by referring to the following detailed specification and claims taken in connection with the appended drawings.

DETAILED DESCRIPTION OF THE PREFERRED EMBODIMENT

Figure 1:
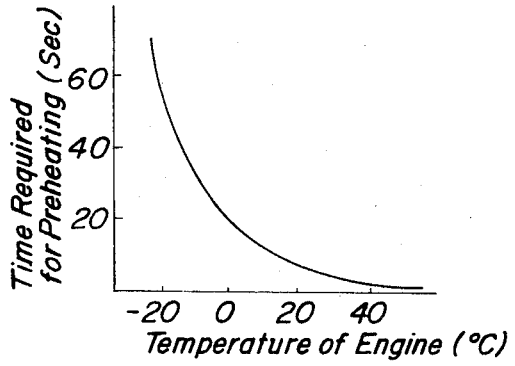
FIG. 1 is a graph illustrating a relationship between temperatures of engines and time required for preheating them.

In a Diesel engine with a preheating or glow plug, before cranking the engine by driving a starter motor, an electric current is applied to the preheating plug to heat it to a temperature at which the starter motor is started. The time required for the preheating depends upon the temperature of the engine. For example, the preheating time is less than a few seconds at a temperature higher than 20° C. and as much as 60 seconds at −20° C. as shown in FIG. 1.

Figure 2:
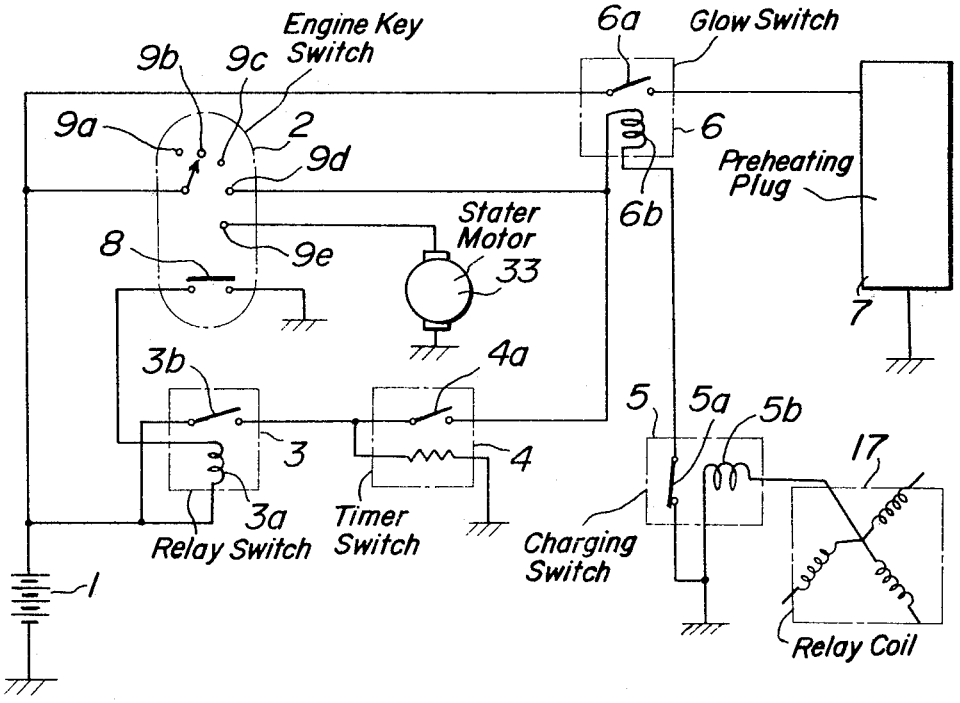
FIG. 2 is a circuit showing one embodiment of the invention.

FIG. 2 illustrates one embodiment wherein a circuit constituting the system according to the invention comprises a battery 1, an engine key switch 2, a relay switch 3, a timer switch 4, a charging switch 5, a glow relay 6 and a preheating or glow plug 7.

Figure 3:
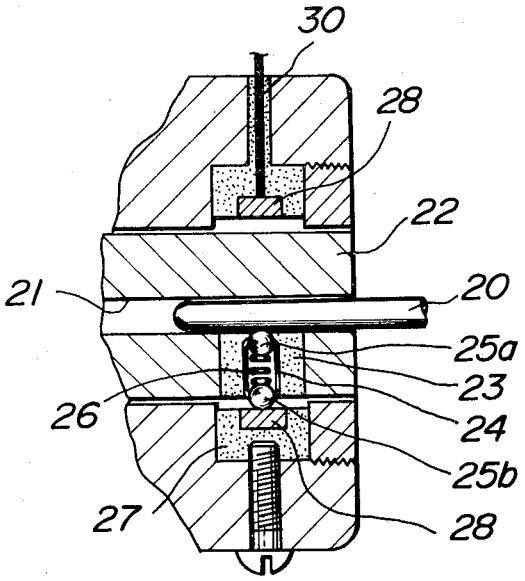
FIGS. 3 and 4 are sectional views of key switches for use in the system according to the invention.
Figure 4:
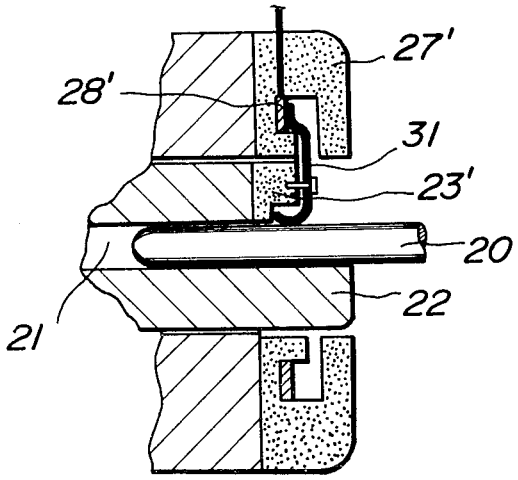

The engine key switch 2 comprises an instantaneous glow switch 8, shown in detail in FIGS. 3 and 4 and adapted to be turned on when an engine key is inserted into a key hole, a key-off contact 9*a*, an accessory contact 9*b*, a fuel pump contact 9*c*, a glow contact 9*d* and a starter contact 9*e*.

The relay switch 3 includes a relay coil 3*a* adapted to be energized upon closing the glow switch 8 and actuates the timer switch 4 when a normally opened contact 3*b* is closed by means of the relay coil 3*a*.

Figure 5:
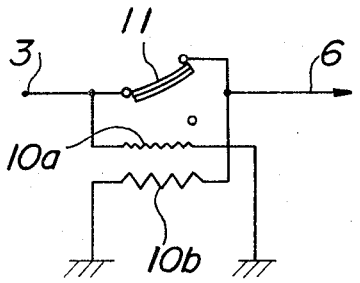
FIGS. 5 and 6 illustrate circuit arrangements of embodiments of timer switches used in the present invention.

The timer switch 4 keeps its contact 4*a* closed only for a determined period of time after an operation of the timer switch 4. FIG. 5 illustrates one embodiment of the timer switch 4 comprising a heater 10*a* of a nichrome wire of a small capacity for warming, and a heater 10*b* of a nichrome wire of a large capacity for heating to operate a or turn bimetal switch 11. When the relay switch 3 becomes conductive, an electric current flows through the bimetal switch 11 to supply current to the heaters 10*a* and 10*b* simultaneously. The bimetal switch 11 heated by the heater 10*b* is turned on the opposite side after a determined time to open the contact 4*a* so that the heater 10*b* ceases the heating, while current still flows through the heater 10*a* which continues to heat the bimetal switch 11 to a degree such that the turned bimetal is kept in the switched-over position. Accordingly, after the operation of the relay switch 3 the contact 4*a* is maintained closed until the bimetal switch 11 is turned, but after the turning of the bimetal switch 11, the contact 4*a* is kept opened.

Figure 6:
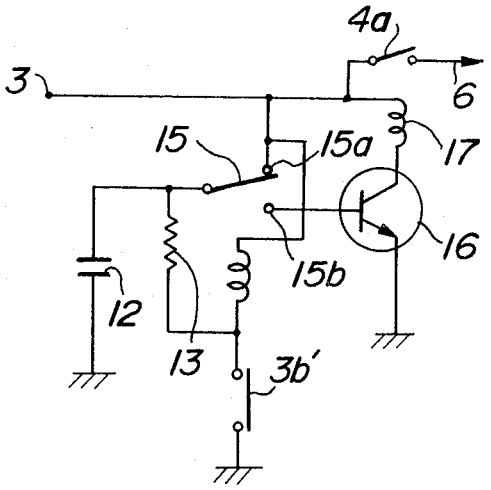

FIG. 6 illustrates another embodiment of the timer switch 4 wherein the contact 4*a* is kept closed only for a period of time determined by time constants of a condenser 12 and a resistance 13. The timer switch 4 comprises a relay 15 adapted to change over from a contact 15*a*, to a contact 15*b* by an operation of the switch 3*b*′ interlocked with the relay switch 3 and normally opened contact 3*b*, a transistor 16 having a base to be applied with the charging voltage from the condenser 12 and adapted to become conductive when the relay 15 is changed over from the contact 15*a* to the contact 15*b*, and a relay coil 17 maintaining the contact 4*a* closed while the transistor 16 is conductive. When an electric potential of the condenser 12 has lowered through the resistance 13 after a determined period of time, the transistor 16 becomes nonconductive to open the contact 4*a*.

Referring back to FIG. 2, the glow relay 6 normally feeds current to the preheating plug 7 through the contact 6*a* which is kept closed while the timer switch 4 is closed. Since, however, the relay coil 6*b* is grounded through the charging switch 5, when an electric potential at the neutral point of an alternator 17 rises, the coil 5*b* is excited to open the contact 5*a* and hence deenergize the glow relay 6. The glow relay 6 is also operated by means of closing the glow contact 9*d* of the engine key switch 2, thereby to feed an electric current to the preheating plug 7 for any desired time.

The glow switch 8 is so constructed as shown in FIG. 3 that in order to switch on the glow switch 8 instantaneously by an insertion of the engine key 20, a rotary shaft 22 having a key hole 21 for receiving the engine key 20 has provided therein an insulating guide 23 formed with a guide hole 24. Conductive balls 25*a*, 25*b* arranged at the ends of guide hole 24 are urged outwardly by a conductive spring 26, so that the ball 25*b* is normally in contact with a conductor ring 28 provided in an insulating ring 27 arranged outside thereof and the other ball 25*a* extends partially in the key hole 21 and is adapted to be connected to the rotary shaft 22 on the grounded side of the switch through the inserted engine key 20.

Accordingly, the conductor ring 28 is connected through a lead wire 30 to a positive side of the switch, and the conductor ring 28 is connected to the grounded side of the switch through the ball 25*b*, spring 26, ball 25*a* and inserted key 20.

FIG. 4 illustrates other embodiment of the glow switch, wherein there is provided a conductive brush 31 of a leaf spring instead of the balls 25*a* and 25*b* and spring 26 of FIG. 3. The brush 31 is secured to an insulating guide 23′ and includes an outer end normally in contact with a conductor ring 28′ and an inner end partially extending into the key hole 21 so as to be in contact with the inserted engine key 20, so that the insertion of the engine key 20 immediately closes the glow switch 8 in the same manner as above described.

With such arrangements, upon inserting the engine key 20 into the key switch 2 in starting the engine, the glow switch 8 is closed to cause a current to flow through the relay switch 3 and timer switch 4 to the glow relay 6 closing the contact 6*a* resulting in the energization of the preheating plug.

Thereafter, the engine key 20 is rotated to close the starter contact 9*c*, so that the starter motor 33 is driven to start the engine. When the starting is completed and the engine operates by itself without requiring the starter motor, the generated potential of the alternator 17 rises sufficiently to open the charging switch 5 so that no current flows through the glow relay 6 to the preheating plug 7.

Therefore, even if the timer switch 4 remains ON, the glow relay 6 becomes OFF owing to the independent operation of the engine which does not require heating by the preheating plug 7.

In this manner after the engine is started, the operation of the charging switch 5 prevents current from flowing to the preheating plug 7 so long as the engine stops.

If it is desired in starting to continue heating the preheating plug 7 for a period of time longer than that determined by the timer switch 4, the time can be increased to a desired extent by holding the glow contact 9*d* in its closed position.

Even if the engine key 20 is left inserted in the key hole, the timer switch 4 operates to switch off the glow relay 6 after a determined time, whereby the preheating plug is prevented from being overheated.

In this case, although an electric current always flows through the warming heater 10*a* of the timer switch 4 in FIG. 5, a current consumption is not noticeable because of the small capacity of the heater.

Figure 7:
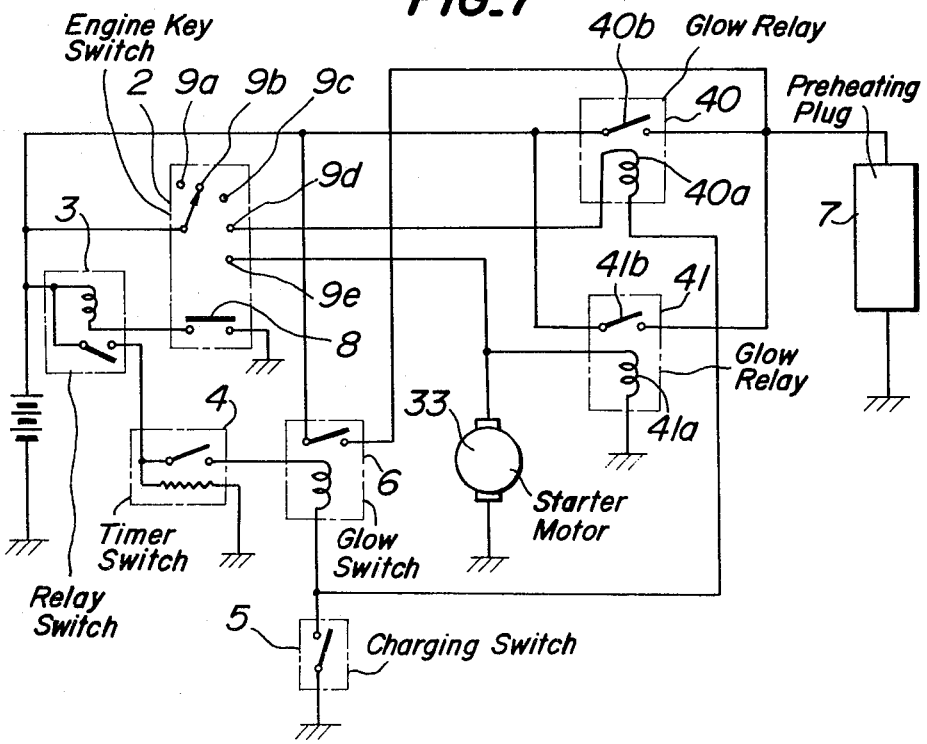
FIG. 7 is a circuit showing another embodiment of the invention.

FIG. 7 illustrates a further embodiment of the invention. The system of this embodiment further comprises glow relays 40 and 41. A relay coil 40*a* of the glow relay 40 is connected to the glow contact 9*d* and a relay coil 41*a* of the glow relay 41 is connected to the starter contact 9*e*. Normally opened contacts 40*b* and 41*b* are connected in parallel between the preheating plug 7 and battery 1.

With this arrangement, an insertion of the engine key 20 operates the glow relay 6 to cause current to flow to the preheating plug 7. When the engine key 20 is rotated to close the glow contact 9*d*, the glow relay 40 is operated. If the engine key 20 is further rotated to the position of the starter contact 9*e*, the glow relay 40 is opened but the glow relay 41 is operated to heat the preheating plug 7 while the starter motor 33 is being driven.

As can be seen from the above explanation, according to the invention a current is fed to the preheating plug to start the heating as soon as an engine key is inserted, so that even if the atmospheric temperature is relatively high, it is possible to preheat the plug for 1–2 seconds before driving a starter motor, so that the starting characteristic of an engine can be remarkably improved and the time required for the preheating as a whole can be shortened in a cold season.

Moreover, all that is required of a driver for the preheating is to insert an engine key, so that the troublesome starting operation of an Diesel engine can be somewhat simplified according to the invention.

In a warm environments where the time required for the preheating is usually very short, the device according to the invention achieves the starting characteristic of a Diesel engine substantially equal to that of a gasoline engine.

Figure 8:
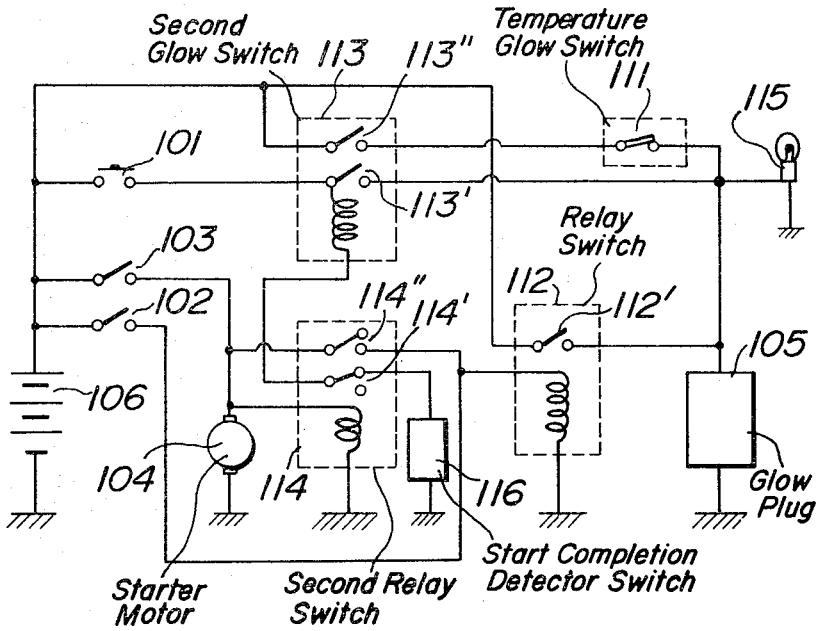
FIG. 8 is a circuit showing further embodiment of the invention.

FIG. 8 illustrates a preferred embodiment of the invention which is able to shorten the time required for preheating. A first operation of an engine key completes a circuit including a first glow switch 102 and a first relay switch 112 with a battery 106. In parallel with the circuit, a starter switch 103 and a starter motor 104 are connected by means of a second operation of the engine key. A second relay switch 114 is connected in parallel with the starter motor 104. A glow plug 105 and a contact 112' operated by the first relay switch 112 form another circuit together with the battery 106. An indication lamp 115 for indicating an energization of a glow plug 5 is connected in parallel therewith.

The contact 112' of the first relay switch 112 is closed when its coil is energized and opend when the coil is deenergized.

The second relay switch 114 includes two contacts 114' and 114''. The second contact 114'' completes a circuit from the starter switch 103 to the first relay switch 112 and is closed when a relay coil of the relay switch 114 is energized and opened when the coil is deenergized.

There are further provided with a second glow switch 101, a third relay switch 113 and a temperature sensor switch 111. The second glow switch 101, a coil of the third relay switch 113, the first contact 114 of the second relay switch 114 and a start completion detector switch 116 are connected in series to form a circuit. The first contact 114' is closed when a relay coil of the second relay switch 114 is deenergized and opened when the coil is energized (when the starter switch is closed). The start completion detector switch 116 is closed when the engine stops and opened after completion of engine starting.

The third relay switch 113 includes two contacts 113' and 113''. The first contact 113' is connected between the second glow switch 101 and the glow plug 105 and indication lamp 115 to form a preheating starting circuit and is closed when a relay coil of the third relay switch 113 is energized and opened the relay coil is deenergized.

The second contact 113'' of the third relay switch 113 and the temperature sensor switch 111 are connected in series to form a self-holding circuit and a preheating holding circuit for the glow plug 105. The temperature sensor switch 111 is so arranged to be opened when the glow plug 5 is at a temperature higher than a determined value.

The start completion detector switch 116 is so constructed as to be operated, for example, by means of pressure in an engine oil. Before starting the engine the detector switch 116 is closed because no oil pressure exists. Upon completion of starting the engine the detector switch 116 is opened by means of the pressure in the engine oil. A voltage regulator may be utilized for this purpose. In this case the detector switch 116 is closed before starting the engine because no generated electric current exists and opened upon completion of starting the engine.

The first glow switch 102, which is conventional, is closed by a rotation of an engine key to cause a current to flow through the first relay switch 112, thereby closing the contact of the first relay switch 112 to supply a current to the glow plug 105 starting the preheating. Upon completion of preheating, the engine key is further rotated to close the starter switch 103 for driving the starter motor 104. At this moment, the second relay switch 114 is also energized to close the second contact 114" thereof, thereby continuing supplying current to the first relay switch 112 resulting in a continuous heating of the glow plug 105.

The second glow switch 101 is located near a seat of a driver which pushes the second glow switch 101 as soon as he opens a door of a vehicle before starting the engine in a cold season. As a result, the coil of the third relay switch 113 is energized to close the first and second contacts, thereby supplying a current to the glow plug 5 to start the preheating. Once the driver has pushed the second glow switch 101, the second contact 113", temperature sensor switch 111, first contact 113' and the coil of the third relay switch 113 form a self-holding circuit to continue energizing the glow plug 105 through the second contact 113".

When a driver wishes to start the engine, he pushes the second glow switch 101 to start the preheating immediately. Thereafter the driver sits on a seat, wears seat belts and inserts an engine key, during which a few tens of seconds usually elapses. In most cases, the preheating is completed during this short time to enable the starter motor to drive immediately. Even if further preheating of the glow plug is needed, the time required for the remaining preheating can be shortened because the preheating has progressed to a substantial degree.

It is therefore desirable to arrange the second glow switch 101 at a location which enables a driver to push it as soon as he opens a door of a vehicle for driving it.

Once the second glow switch 101 has been pushed, the coil of the third relay switch 113 is energized to close its first and second contacts and even if the second glow switch 101 is opened, the coil is maintained energized by means of the second contact to continue the preheating.

In order to avoid an overheating of the glow plug 105 which would affect its durability, the temperature sensor switch 111 (which is, for example, a bimetal switch) opens to cut off the current flow to the glow plug 105, if the temperature of the glow plug 105 rises higher than a predetermined temperature.

At the moment that the starter motor 104 is energized after completion of the preheating, the first contact of the second relay switch 114 is opened to cut off the current flow through the second glow switch 101 to the glow plug 105. When the starter motor 104 is being energized, the second contact 114" of the second relay switch 114 is closed to supply current to the glow plug 105.

Even if the second glow switch 101 is unintentionally pushed after the engine started, the third relay switch 113 is not closed and the glow plug 105 is not energized because the start completion detector switch 116 has been opened.

When the starting condition is so good that the second glow switch is not needed, the first glow switch may be used. Even if a driver fails in a first starting operation, the glow mechanism other than the second glow switch remains unaltered, so that no problem arises with the failed operation. Moreover, even if the driver fails to push the second glow switch 101, the glow mechanism other than the second glow switch 101 remains unaltered, so that the time required for the preheating is never extended in comparison with the case without the second glow switch 101.

In the event that the glow plug is overheated because a long time is required from the pushing of the second glow switch 101 to the starting of the engine and the temperature sensor switch 111 is then opened to automatically cut off the current flow to the glow plug 105, the preheating time by means of the first glow switch 102 is remarkably shortened.

According to this embodiment as above described, an addition of simple means to an existing system can remarkably shorten the time required for the preheating without increasing the cost and can increase the durability of the system.

Figure 9:
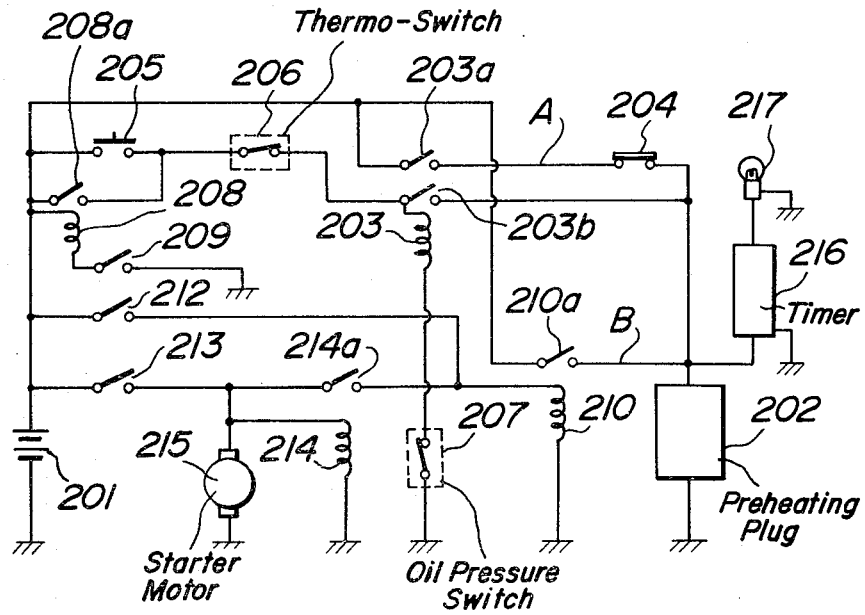
FIG. 9 is a circuit illustrating other embodiment of the invention.

FIG. 9 illustrates a further embodiment of the invention, wherein between a battery 201 and a preheating or glow plug 202 are connected in series a first normally opened contact 203*a* of a relay 203 and a normally closed bimetal switch 204 to form a first current flow circuit A (which serves also as a second current flow circuit).

One end of the relay 203 is connected to a positive terminal of the battery 201 in series with an automatic return type normally opened push button switch 205 and a normally closed thermo-switch 206 which senses water or oil temperature and opens at a temperature higher than a determined temperature. The one end of the relay 203 is also connected through its second contact 203*b* to a junction between the bimetal switch 204 of the first current flow circuit A and the glow plug 202. The other end of the relay 203 is grounded through a normally closed oil pressure switch (or charging lamp switch) 207 which opens at an engine rotating speed higher than its idling speed.

The push button 205 is arranged near a door on the side of a driver and more preferably at a location near at hand when the driver out of a car has opened the door.

Between the battery 201 and the thermo-switch 206 is connected a contact 208*a* of a relay 208 in parallel with the push button switch 205. The relay 208 has one end connected to the positive terminal of the battery 201 and the other end is grounded through a switch 209.

Figure 10:
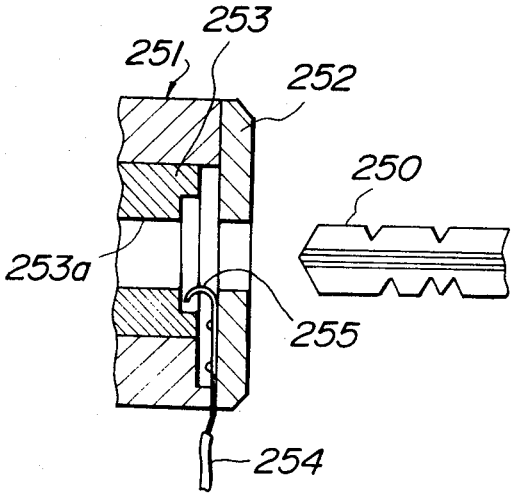
FIG. 10 is a partial sectional view of a key switch used in the embodiment shown in FIG. 9.

The switch 209 is a normally opened key switch which is closed when an engine key is inserted and is constructed as shown in FIG. 10. The switch 209 comprises a main body 251, a cover 252, a rotary body 253 having a guide hole 253*a* for receiving an engine key 250, a lead wire 254 and a ground terminal 255. When the engine key 250 is inserted in the guide hole 253*a* of the rotary body 253, the key becomes in contact with the ground terminal 255 to close the switch 209 shown in FIG. 9. If the key 250 is rotated together with the rotary body 253, the switch 209 is opened.

The battery 201 and the glow plug 202 are connected through a contact 210*a* of a relay 210 to form a third current flow circuit B. One end of the relay 210 is connected to the positive terminal of the battery 201 through a switch (a preheating contact of the key switch) 212. In parallel with the switch 212, a switch (a starter contact of the key switch) 213 and a contact 214*a* of a relay 214 are connected in series in the circuit. The other end of the relay 210 is grounded. One end of the relay 214 is connected to the positive terminal of the battery 201 through the switch 213 and the other end is grounded. A starter motor 215 is connected through the switch 213 to the battery 201. This circuit includes a timer 216 and a pilot lamp 217.

The operation of this arrangement will be explained hereinafter. It is assumed that the thermo-switch 206 and the oil pressure switch 207 are closed. When the push button switch 205 is pushed, an electric current flows through the relay 203 to close its contacts 203*a* and 203*b*, with the result that a current is fed from the battery 201 to the glow plug 202 through the contact 203*a* and the bimetal switch 204 or the first current flow circuit A. Now the circuit for flowing a current from the first circuit A to the contact 203*b*, relay 203 and oil pressure switch 207 has been completed to form a self-holding circuit, so that even if the push button switch 205 is released, the self-holding circuit continues to supply current to the glow plug 202.

When the glow plug 202 is red hat or a determined time for flowing a current has expired, the bimetal switch 204 opens to stop the current to the glow plug 202 for preventing it from burning and the power of the battery from being consumed. Thereafter, any restoration of the bimetal switch 204 does not close again the circuit.

If the temperature of the engine is relatively high, the thermo-switch 206 is kept opened and if the engine rotating speed is higher than the idling speed, the oil pressure switch is maintained opened, so that even if the push button 205 is pushed, the relay 203 is not actuated and therefore no current flows to the glow plug 202. If the oil pressure switch 207 is opened while current is fed to the glow plug 202 by means of the operation of the push button switch 205, the current to the glow plug 202 is stopped.

Since the push button switch 205 is arranged near the door on the side of the driver as above described, it can be pushed down as soon as he opens the door, so that the start of the preheating can be made as early as possible.

Without pushing the push button switch 205 the engine key 250 is only inserted into the key switch body 251 to close the switch 209 so that a current flows through the relay 208 to close its contact 208*a*. As the contact 208*a* is connected in parallel with the push button switch 205 and operates in the same manner as the switch 205, the closed contact 208*a* actuates the relay 203 to complete the first current flow circuit A which begins to supply current to the glow plug 202.

With this arrangement, because the current flow circuit is common to the push button switch 205 and the switch 209 adapted to be closed by the insertion of the engine key, the provision of these switches side by side scarcely increases the cost as a whole.

Moreover, current can be supplied to the glow plug 202 in the determined rotated position of the engine key at will. In other words, in preheating position, the switch 212 is closed to cause current to flow through the relay 210 so that its contact 210*a* is closed to supply the current to the glow plug 202 through the third current flow circuit B. In this case, the pilot lamp 217 which is supplied with a current through the timer 216 is deenergized to indicate the proper preheating time. In the starter motor starting position of the engine key, furthermore, the switch 213 is closed to energize the starter motor 215 and the relay 214 to close its contact 214*a*. This in turn causes the relay 210 to be energized to close its contact 210*a*, as a result, the glow plug 202 is energized through the third current flow circuit B, thereby maintaining the current flow to the glow plug 202 while the starter motor is being energized (during the cranking of the engine).

When the engine key is returned to its original position to stop the engine, the engine key assumes the position where it was inserted, so that the switch 209 becomes closed. However, the thermo-switch 206 is kept opened so long as the temperature of the engine is high, so that the glow plug 202 is not energized. In this case, if the thermo-switch 206 is set at approximately 30° C. of the cooling water, the thermo-switch 206 is kept opened for about one hour after the stoppage of the engine even in midwinter.

As above mentioned, according to this embodiment, preheating can be started by the operation of the push button switch as soon as the door of a vehicle is opened, so that the preheating is effected during the time required for opening the door, sitting down on the seat and inserting an engine key, so that the preheating time can be substantially shortened as a whole. Moreover, the insertion of the engine key automatically begins the preheating without requiring the pushing of the push button switch. In this case, the preheating time can be shortened by the time for operating the engine key, although it is only a few seconds.

Figure 11:
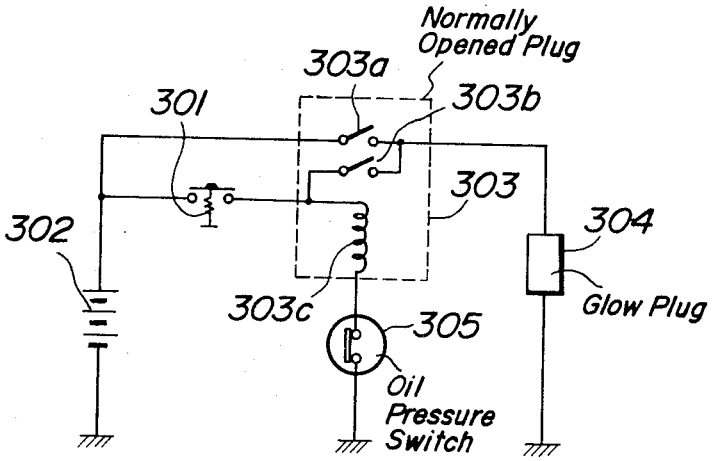
FIG. 11 is a circuit of another embodiment of the invention.

FIG. 11 illustrates a further embodiment wherein when engine oil pressure arrives at a predetermined pressure, the preheating plug is deenergized the embodiment, comprises a normally opened glow switch 301, a battery 302, a normally opened relay 303 having two contacts 303*a* and 303*b* and a coil 303*c*. A glow plug 304 is arranged in a precombustion chamber and an oil pressure switch 305 adapted to be deenergized when pressure in the engine oil becomes a determined pressure. The switch 305 is a conventional one generally provided for igniting a pressure indication lamp for engine oil.

Before engine starting, when the glow switch 301 is pushed to supply current from the battery 302 to the coil 303*c* of the relay 303 owing to the closed oil pressure switch 305, the contacts 303*a* and 303*b* are immediately closed to energize the glow plug 304. Because the glow switch 301 is normally opened, it is immediately opened when released. The contacts 303*a* and 303*b* are, however, connected in parallel with the glow switch 301 to form a self-holding circuit for maintaining the current flow to the glow plug 304. Thereafter the engine is started and then the pressure in the engine oil reaches a determined pressure. Until the pressure in the engine oil reaches the determined pressure, the glow plug 304 is maintained energized to supply the lack of thermal energy for starting the engine. When the oil pressure switch 305 is switched off, the glow plug 304 is deenergized.

The pressure in the engine oil which operates the pressure switch 305 depends upon the engine operating condition and the engine oil temperature. The pressure is generally proportional to the engine rotating speed until the pressure reaches the order of $5.0 \pm 1.0$ kg/cm$^2$ regulated by a pressure control device, so that the engine rotating speed may be used for this purpose instead of the pressure in the engine oil. It is therefore most effective for the after-glowing system to determine, by referring to the engine rotating speed, the optimum time when the glow plug is deenergized. In this embodiment, the oil pressure switch 305 is switched off when the engine rotating speed reaches 600–1,000 rpm.

Figure 12:
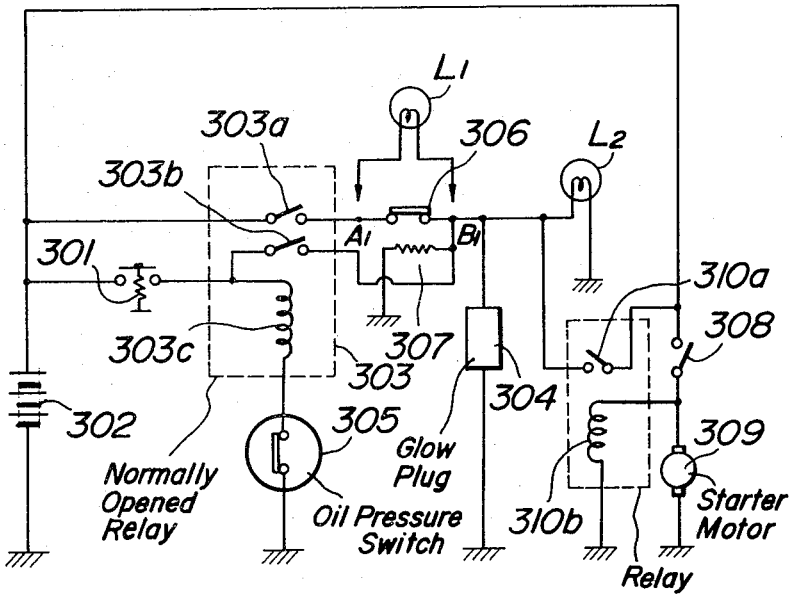
FIG. 12 is a circuit of a further embodiment of the invention.

FIG. 12 shows a more detailed embodiment than that shown in FIG. 11, wherein like components have been designated by the same reference numerals as in FIG. 11. The circuit shown in FIG. 12 comprises a bimetal switch 306 for protecting this system and a heater 307 for operating the bimetal switch 306 by heating, and further comprises a starter switch 308, a starter motor 309, a relay 310 having one contact 310*a* and a coil 310*b*, a lamp $L_1$ which will be explained later and a lamp $L_2$ indicating that the glow plug 304 is energized.

In operation, when the glow switch 301 is pushed, the contacts 303*a* and 303*b* of the relay 303 are simultaneously closed to supply a current from the battery 302 to the glow plug 304 and to energize the lamp $L_2$. Even if the glow switch 301 is opened, the glow plug 304 is maintained energized to continue heating the precombustion chamber. Thereafter, the starter switch 308 is closed to energize the starter motor 309 for starting the engine. After the start of the engine, therefore, the pressure in the engine oil begins to rise and reaches a determined pressure at the engine rotating speed 600–1,000 rpm, at which moment the oil pressure switch 305 is opened. Accordingly, the self-holding circuit in the relay 303 is opened so that the glow plug 304 is deenergized and the lamp $L_2$ is also deenergized.

With the circuit shown in FIG. 11, the glow switch 301 is pushed to energize the glow plug 304. When the engine is inoperative or the pressure switch 305 does not turn of for any reason after the start of the engine, the glow plug 304 may be kept heated. There thus may be a risk that the heated wire of the glow plug 304 will be damaged and the battery consumed. With the embodiment shown in FIG. 12 bimetal switch 306 is provided in the circuit for energizing the glow plug 304. In that case, therefore, the bimetal switch 306 is overheated by the heater 307 to open the circuit thereby preventing the glow plug 304 from being unduely energized. In this case the lamp $L_1$ is so connected to points $A_1$ and $B_1$ as shown in FIG. 12 that the lamp $L_1$ is lighted when the bimetal switch 306 is opened to deenergize the glow plug 304, thereby indicating the fact the glow plug 304 has been sufficiently heated. The time until the bimetal switch is opened is preferably 1–2 minutes.

The relay 310 is provided to supply a current to the glow plug 304 when starting the engine other than the above circuit for supplying current to the glow plug 304. When the starter switch 308 is closed to cause a current to flow through the coil 310*b*, the contact 310*a* is closed to energize the glow plug 304.

According to the embodiments shown in FIGS. 11 and 12, the existing oil pressure switch usually provided in an engine is utilized to provide the preheating plug heating system which is inexpensive to manufacture, durable and useful. Furthermore, bimetal switch may be used for the protection of the system to improve its safety.

Figure 13A:
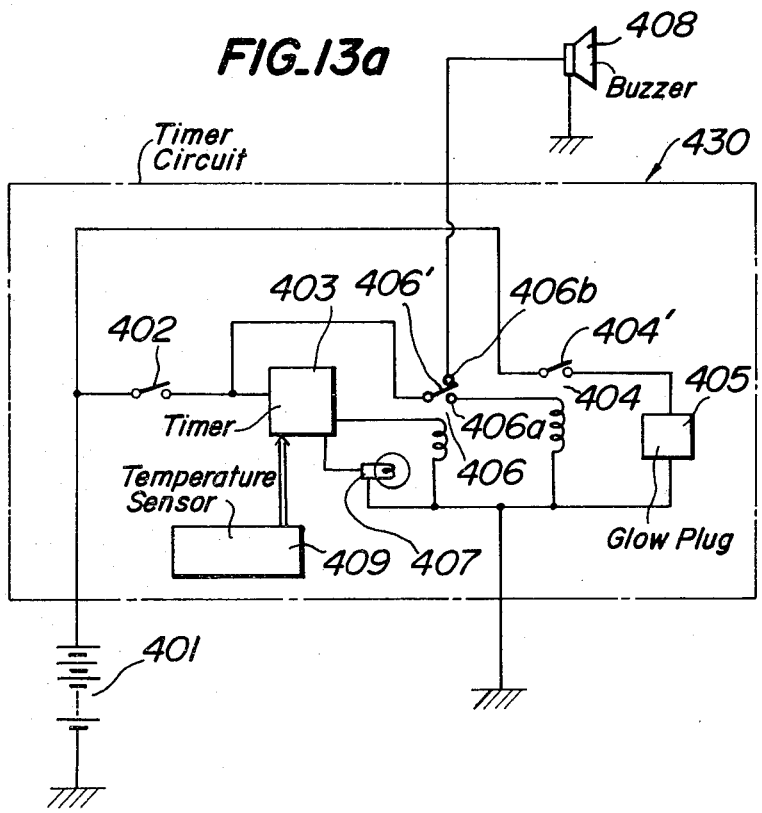
FIGS. 13*a* and 13*b*, 14 and 15*a* and 15*b* are circuits of still other embodiments of the invention.

Referring to FIG. 13*a* illustrating one embodiment of a warning device for detecting an overheated condition of the glow plug, a circuit comprises a battery 401, a glow switch 402, a timer 403, a glow plug relay 404 for ignition of a glow plug 405, a relay 406 for actuating the timer 403, a glow lamp 407, a buzzer 408 and a temperature sensor 409 for air or water. The timer 403 is set to obtain the optimum glowing time with the aid of the temperature sensor 409 detecting the atmospheric temperature or the temperature of engine cooling water. When the glow switch 402 is closed to cause a current to flow through the timer 403, the relay 406 is operated to connect its switching arm 406' to a contact 406*a*, so that the relay 404 is operated to close its contact 404'. In this manner, the glow plug 405 is heated and then its temperature rises to a suitable temperature. The timer 403 is now operated to change over the switching arm 406' of the relay 406 from its contact 406*a* to 406*b*, so that the contact 404' of the relay 404 is opened to deenergize the glow plug 405 and simultaneously the buzzer 408 is operated. At this moment the brightness of the glow lamp 407 is increased by the timed operation of the timer 403 for visually alarming a driver.

Figure 13B:
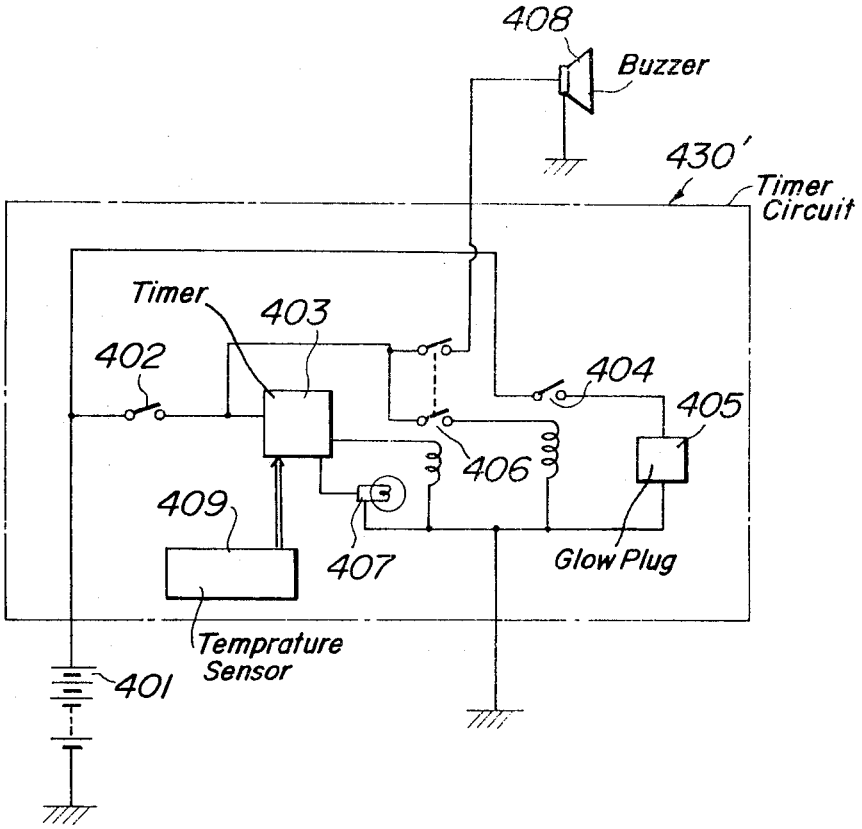

It is understood by those skilled in the art that in place of the above system for alarming the time that the heating of the glow plug has been completed, the circuit may be slightly modified such that the buzzer is energized at the same time as the glow switch is closed and deenergized at the same time as the heating of the glow plug has been completed. Such a circuit is shown in FIG. 13*b*.

Figure 14:
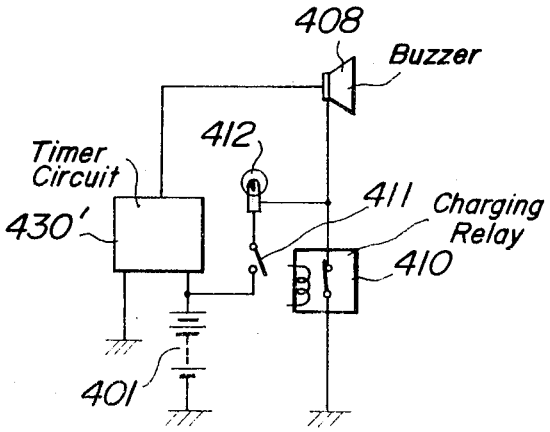

FIG. 14 illustrates a further embodiment. In this system, an earthed or grounded side of the buzzer 408 is connected to an L-terminal of a charging relay 410 of a voltage regulator and is grounded through a contact of the voltage regulator charging relay 410. This circuit utilizes a timer circuit 430' similar to that shown in FIG. 13*b* which is modified in the relation of the normally closed and opened relay contacts in the timer circuit 30 for the glow plug preheating control such that the buzzer 408 is energized at the same time as the glow switch is closed, and the buzzer 408 and the charge lamp 412 are simultaneously deenergized by opening the L-terminal of the voltage regulator charging relay 410 at the same time as the engine is started. The numeral 11 shows an ignition switch.

With this arrangement, when the engine has been started, the buzzer is immediately deenergized irrespective of continuation of the after-glowing to avoid undue energization of the buzzer. The after-glowing is generally effected in order to improve the stability of warming up idling after the starting of an engine.

Figure 15A:
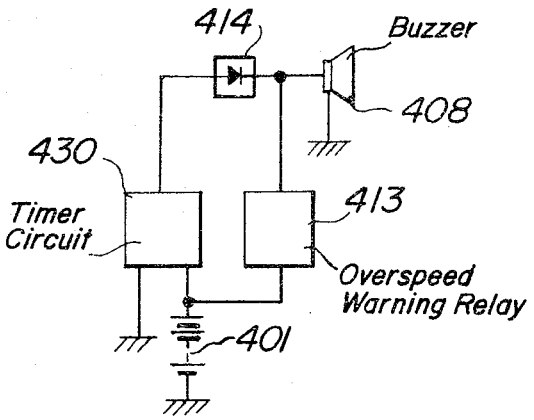
Figure 15B:
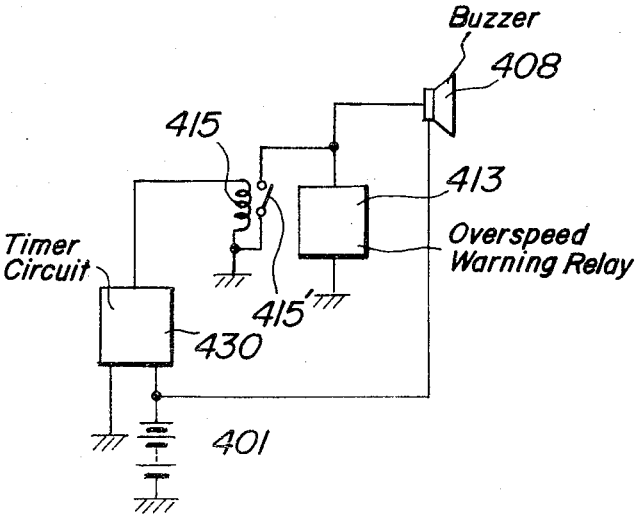

FIGS. 15*a* and 15*b* show preferred embodiments utilizing a power source and a buzzer of an overspeed warning circuit including an overspeed warning relay 413 and a buzzer 408 to dispense with one buzzer. In FIG. 15*a*, to an output of a timer circuit 430 is connected a diode 414 which is further connected to a buzzer 408 for energizing the buzzer after a predetermined period of time. In FIG. 15*b*, in an overspeed warning circuit including a power source 401 and an overspeed warning relay 413 having one end grounded are provided a timer circuit 430 and a relay switch 415. When a predetermined period of time has elapsed after the closing of the glow switch, the timer circuit 430 causes a contact 415' of the relay switch 415 to close to energize the buzzer 408.

As shown in the embodiments of FIGS. 15 and 15*b*, any one of the positive and negative sides of the buzzer may be controlled. At any rate, an existing buzzer can be utilized to save cost for this purpose.

According to the embodiments shown in FIGS. 13–15, completion of the preheating can be easily detected to shorten the time for the starter cranking and therefore to prevent the failures of the battery and driving systems. Further completion of the preheating can be detected without visual monitoring, a driver can pay attention to operations other than preheating. An existing buzzer for example for an overspeed warning device can be utilized to provide an inexpensive warning device.

While the invention has been particularly shown and described with reference to preferred embodiments thereof, it will be understood by those skilled in the art that the foregoing and other changes in form and details can be made therein without departing from the spirit and scope of the invention.

What is claimed is:

1. In a preheating system for a Diesel engine including a battery, an engine key switch adapted to receive an engine key, a glow relay means, a preheating plug supplied with an electric current from the battery through the glow relay means, and a charging switch means responsive to an engine operating parameter and coupled to said glow relay means for deenergizing said glow relay means when the charging switch means detects a starting of said engine, the improvement comprising an instantaneous glow switch closed in response to insertion of the engine key into the engine key switch, and a timer switch closed in response to a closing of said glow switch for exciting said glow relay means for a predetermined period of time after the closing of said glow switch.

2. A preheating system as set forth in claim 1, wherein said glow switch comprises a rotary shaft having a key hole for receiving said engine key, a conductor ring carried on an insulating ring about an outer circumference of said rotary shaft, and conductive contact means provided in an insulating guide of said rotary shaft and extending into said key hole, one end of said contact means being maintained in contact with said conductor ring.

3. A preheating system as set forth in claim 2, wherein said contact means comprises two conductive balls, one of said balls extending into said key hole to be in contact with said engine key and the other ball being maintained in contact with said conductor ring, and a conductive spring for outwardly urging said balls.

4. A preheating system as set forth in claim 2, wherein said contact means comprises a leaf spring having a conductive brush and secured to said insulating guide, one end of said brush extending into said key hole to be in contact with said engine key and an opposite end of said brush being maintained in contact with said conductor ring.

5. A preheating system as set forth in any one of claim 1 or 2, wherein said timer switch comprises two heaters, respectively, for heating at a high temperature and for warming at a lower temperature, and a bimetal switch which is actuated upon being heated by the high temperature heater and maintained actuated by a substantially constant temperature by the lower temperature warming heater.

6. A preheating system as set forth in any one of claim 1 or 2, wherein said timer switch comprises a transistor controlled to have its conductive period determined by time constants of a condenser and a resistance, and a relay operated in response to said transistor.

7. A preheating system as set forth in claim 1, wherein said glow relay means comprises first and second glow relays, the first glow relay having a relay coil connected to a glow contact of said engine key switch and the second glow relay having a relay coil connected to a starter contact of said engine key switch, and respective normally opened contacts of said glow relays being connected in parallel between said preheating plug and the battery.

8. A preheating system as set forth in claim 1, wherein said system further comprises a second glow switch, a glow plug preheating circuit coupled to said second glow switch through contacts of a second relay, a self-holding circuit for said second relay, and means for sensing an overheating of said glow plug and interrupting said glow plug preheating circuit.

9. A preheating system as set forth in claim 8, wherein said means for interrupting said glow plug preheating circuit is a bimetal switch.

10. A preheating system as set forth in claim 8, wherein said second relay includes a coil circuit, said coil circuit including a start completion detector switch for interrupting said coil circuit.

11. A preheating system as set forth in claim 10, wherein said start completion detector switch is an oil pressure switch which is opened when a pressure of an engine oil reaches a determined pressure.

12. A preheating system as set forth in claim 10, including a voltage regulator wherein said start completion detector switch is operated to be opened with the aid of said voltage regulator when engine starting is completed.

13. A preheating system as set forth in claim 10, including in the coil circuit of said second relay means for interrupting said coil circuit upon operating a starter motor switch.

14. A preheating system as set forth in claim 8, wherein said second glow switch is located near a vehicle seat, the second glow switch being manually operated.

15. A preheating system as set forth in claim 1, wherein said system comprises a first current flow circuit for supplying a current to said preheating plug including a push button located near a door adjacent a driver's seat, a second current flow circuit including said glow switch closed by the insertion of said engine key into said engine key switch for supplying a current to said preheating plug, and a third current flow circuit for supplying a current to said preheating plug at a determined rotated position of said engine key.

16. A preheating system as set forth in claim 15, wherein said first and second current flow circuits include common, normally opened contacts which are initially closed by one of prior push button operation and engine key insertion and means for maintaining said normally opened contacts closed for substantially a predetermined period of time thereafter.

17. A preheating system as set forth in claim 1, wherein said system further comprises means for acoustically reporting to a driver a preheated condition of said preheating plug.

18. A preheating system as set forth in claim 17, wherein said acoustical means comprises relay means operated following closing of said glow switch, and further comprises sound producing means controlled by said relay means.

19. A preheating system as set forth in claim 18, wherein said sound producing means has a grounded side connected to a terminal of a voltage regulator and is deenergized in response to a completion of starting an engine.

20. A preheating system as set forth in claim 18, including an overspeed warning device wherein said sound producing means includes said overspeed warning device utilized as said sound producing means.

* * * * *